US005864599A

United States Patent [19]

Cowan et al.

[11] Patent Number: 5,864,599

[45] Date of Patent: Jan. 26, 1999

[54] X-RAY MOIRE MICROSCOPE

[76] Inventors: Paul Lloyd Cowan, deceased, late of Naperville, Ill.; Jeanne Louise Cowan, 900 Piedmont Cir., Naperville, Ill. 60565

[21] Appl. No.: 638,211

[22] Filed: Apr. 26, 1996

[51] Int. Cl.[6] ..... G21K 7/00

[52] U.S. Cl. ..... 378/43; 378/73

[58] Field of Search ..... 378/43, 73, 71, 378/70

[56] References Cited

U.S. PATENT DOCUMENTS 5,259,013 11/1993 Kuriyama et al. ..... 378/43

OTHER PUBLICATIONS

"Physik Instrumente" (PI), Catalog 109–12/90–15, section 7, Waldbraun, Germany, pp. 5.6, 5.7 and 8.6.

"X–Ray Microscopes", Malcolm R. Howells, Janos Kirz and David Sayre, Scientific American, Feb. 19, 1991, vol. 264,, p. 8–94.

"Main Crystallographic Situations for the Formation of X–Ray Moir´´Patterns", P.A. Bezirganyan, S.E. Bezirganyan & A. O. Aboyan Phys. Stat. Sol. (a) 126, 41 (1991).

Use of the Ewald sphere in aligning crystal pairs to produce X–ray moir´´fringes, J. Bradler & A.R. Lang, Acta Cryst. 1968 A 24, 246.

"X–Ray Microscopy by Successive Fourier Transformation", J.T. Winthrop & C.R. Worthington, Univ. of Michigan, Dept. of Physics, Feb. 15, 1965.

"X–Ray Microprobe–Microscopy", C.J. Sparks & C.E. Ice, AIP Conf. Proc. 215.

"X–Ray Imaging with Coded Masks", Gerald K. Skinner, Scientific American, Aug. 1988, pp. 84–89.

"Multiplexing Methods in Spectroscopy", Neil J. Sloane, Mathematics Magazine, vol. 52, No. 2, Mar. 1979.

"Lensless Fourier–Transform Method for Optical Holography", George W. Stroke, Applied Physics Letters, vol. 6, No. 10, May 15, 1965.

"Soft X–Ray microscope Using Fourier Transform Holography", I. McNulty, J. Kirz and C. Jacobsen, E. anderson, & M.R. Howells, and H. Rarback, Nuclear Instruments and Methods in Physics Research A291 (1990), pp. 74–79.

*Primary Examiner*—Don Wong

*Attorney, Agent, or Firm*—Jacobson, Price, Holman & Stern

[57] ABSTRACT

An X-ray microscope having an incident X-ray beam (10) from an X-ray source, a first crystal element (14) extending at an angle (β) across the path of the incident X-ray beam (10), a second crystal element (16) extending parallel to the first crystal element (14) and in spaced relationship (22) thereto, a sample (20) in spaced relationship to the second crystal element (16) and downstream thereof relative to the incident X-ray beam, the first and second crystal elements being movable relative to each other and to the incident X-ray beam so that the orientation of atoms in the second crystal element do not match the orientation of atoms in the first crystal element to thereby produce a forward incident X-ray beam (26) in the direction of the original beam (10) and a diffracted X-ray beam (28) at an angle relative to the incident X-ray beam, the forward and diffracted beams being directed onto the sample (20), a forward beam detector (12) for receiving the forward X-ray beam and a diffracted X-ray detector (38) for receiving the diffracted X-ray beam. Aperture elements (32, 36) are provided in front of the detectors (12, 38) for controlling the forward and diffracted beams incident on the detectors.

10 Claims, 2 Drawing Sheets

X-RAY MOIRE MICROSCOPE

BACKGROUND OF THE INVENTION

This invention relates to an X-ray microscope and more particularly to a new type of X-ray microscope using an imaging technique combined with production and control of Moiré patterns by X-ray diffraction from crystals. Hereafter referred to as the X-ray Moiré microscope (XMM)

X-ray microscopes are described in "X-ray Microscopes", by Malcolm R. Howells, Janos Kirz and David Sayre, Scientific American, Feb. 1991, Vol. 264, pp. 8–94. As stated in this publication, the development of X-ray crystallography early in the twentieth century yielded accurate images of matter at atomic resolution. Subsequently electron microscopes have been developed and provide direct views or viruses and minute surface structures. Another type of microscope utilizing X-rays rather than light or electrons, provides a different way of examining tiny details, and considerably improves on the resolution of optical microscopes. They can also be used to map the distribution of certain chemical elements, form pictures in extremely short times, and have the potential for special capabilities such as 3-dimensional imaging. X-ray microscopy differs from conventional electron microscopy in that specimens can be kept in air and in water, whereby biological samples can be studied under conditions similar to their natural state.

As further described in the above article, imaging X-ray microscopes use focusing optics to form an image magnified a few hundred times, which can then be recorded by a detector of modest resolution. The principle benefit of imaging X-ray microscopes is that the entire sample is illuminated and imaged at once, which permits rapid picture taking thereby combatting blurred images resulting from motion and minimizing radiation damage in biological samples.

FIGS. 1 and 2 from the above article show examples of an imaging X-ray microscope and a scanning X-ray microscope. In FIG. 1, an X-ray beam 100 from an X-ray source (not shown) passes through a condenser zone plate 102 which focuses the beam on a sample 104 held in a sample holder 106. A micro-zone plate 108 magnifies images of the sample on a detector 110. The image field is indicated at 112. Fresnel zone plates serve as condenser 102 and objective 108 X-ray lenses. In the scanning X-ray microscope shown in FIG. 2, X-ray beam 114 from an X-ray source passes through a source pinhole 116 onto a zone plate 118 and then through an aperture 120 onto the sample 122 held in a sample holder with X-Y raster scan 124 and then onto an X-ray counter 126. The focused X-ray beam scans back and forth, top to bottom across the sample. The rays that penetrate at each point are measured using a proportional X-ray counter.

U.S. Pat. No. 4,870,674 shows an X-ray microscope of the type wherein the object is illuminated at least partially coherently by a condenser with quasi-monochromatic X-ray radiation and is imaged enlarged in the image plane by a high-resolution X-ray objective. An element which imparts a phase shift to a preselected order of diffraction of the radiation is arranged in the Fourier plane of the X-ray objective to obtain the highest possible image contrast.

U.S. Pat. No. 5,027,377 describes an X-ray microscope or telescope having a connected collection of Bragg reflecting planes comprised of either a bent crystal or a synthetic multi-layer structure disposed on and adjacent to a locus determined by a spherical surface, for producing sharp chromatic images of magnification, which may be greater than or less than unity, from radiation within X-ray band widths propagated from X-ray emitting objects.

U.S. Pat. No. 5,044,001 describes investigating materials by the use of X-rays including a chamber having a wall with an aperture in which is mounted a support substrate composed of a material substantially transparent to X-rays, a first surface on the substrate facing the interior of the chamber and a second surface facing outside the chamber, a metal foil on the first surface having a thickness of less than about 0.1 $\mu$m exposed to the interior of the chamber. A beam of electrons is focused within the chamber on the metal foil to a beam diameter of less than about 1,000 Å incident on the metal foil. The specimen outside the chamber is positioned adjacent to the second surface of the substrate, and at least one X-ray detector is positioned to detect X-rays leaving the specimen. The X-ray detector is an energy dispersive type capable of selecting and recording a narrow range of peak energy and energies close to peak energy.

U.S. Pat. No. 5,016,265 describes a variable magnification variable dispersion glancing incidence X-ray spectroscopic telescope capable of multiple high spatial high revolution imaging at precise spectral lines of solar and stellar X-ray and extreme ultraviolet radiation sources, wherein the spectrum bandpass is readily selectable from a plurality of multi-layer diffraction grating mirrors aft of the primary focus of the primary glancing mirrors on a rotatable carrier, and the magnification and field of view are selectable from a plurality of such carriers, the image being resolved onto one or more X-ray detectors. X-rays of the selected wavelength are reflected and diffracted to produce an overlapping array of images to a detector at the second focus of elliptical diffraction mirrors. Each image corresponds to the emission from the plasma in a single spectral line. The different diffraction grating mirrors on each rotating carrier have the same surface contour, but are coated with multilayer coatings of different multilayer compositions or 2D parameter.

U.S. Pat. No. 3,439,164 describes a method of obtaining X-ray interference patterns using two parallel perfect crystals of the same thickness which exhibit the Borrmann effect, wherein the crystals are oriented so that a monochromatic X-ray beam incident on the first crystal is simultaneously diffracted from two independent sets of planes in the crystal, the two forward diffracted beams are parallel and are directed at a second highly perfect relatively thick crystal whereby four forward diffracted rays are transmitted from the second crystal, two of the four forward diffracted rays transmitted by the second crystal coincide with each other and the phase of the one of the rays incident on the second crystal is varied relative to the other to vary the interference pattern formed by the coincident rays.

Conditions for the formation and observation of X-ray Moiré patterns in crystalline systems are discussed in "Main Crystallographic Situations for the Formation of X-ray Moiré Patterns", by P. A. Bezirganyan, S. E. Bezirganyan, and A. 0. Aboyan, Phys. Stat. Sol. (a) 126, 41 (1991); "Use of the Ewald Sphere in Aligning Crystal Pairs to Produce X-ray Moiré Fringes", by Jay Bradley and A. R. Lang, Acta Cryst. (1968) A 24, 246; and "Dynamic Scattering of X-rays in Crystals" by G. Pinsker, Springer-Verlag, Berlin, 1978.

The development of X-ray microscopes has faced a number of technology problems and up to the present time it cannot be claimed that all of these problems have been solved.

The established approaches can be placed in one of several categories including scanning microscopes, imaging X-ray microscopes, image converting microscopes, and X-ray holography. Scanning X-ray microscopes, like scanning electron microscopes, use a small probe beam of X-rays to produce a signal. which is recorded as either the probe is scanned across the sample or as the sample is scanned through the beam. The small size of the probe beam can be produced either by a focusing element or by a simple pinhole. Imaging X-ray microscopes are more analogous to conventional optical microscopes in that the sample is uniformly illuminated and imaged onto an area detector or film by a magnifying optical element. Image converting X-ray microscopes involve a simple contact image of the sample being recorded onto a photoresist, with the actual magnification performed by electron micrography of the developed resist. X-ray holography depends upon recording the patter of interference between radiation scattered by the sample and a coherent reference source of X-rays.

The technological limitations for these traditional approaches toward X-ray microscopy involve the difficulties of producing suitable optical elements, detectors, photoresists and sources for the X-ray wavelengths employed. X-rays interact weakly with matter, which is an advantage for many applications, but is a severe disadvantage for producing optical elements. Even producing a pinhole, as required for some scanning microscopes, is difficult in that the material around the pinhole must be thick enough to stop the unwanted portions of the illuminating X-ray beam. Both imaging X-ray microscopes and X-ray holography require position sensitive area detectors whose position resolution is ultimately limited by the volume of material required to completely contain the energy deposited by the X-rays upon detection. Production of coherent beams of X-rays tends to limit the total signal even from the brightest X-ray sources available. In addition to holography, X-ray coherence is required for optimal performance of Fresnel zone plates which are the most successful type of X-ray focussing element demonstrated to date. All of the above problems have been addressed with the most success in the soft X-ray regime, i.e., 100 eV–1000 eV where they are typically less severe than at higher photon energies.

The concept of forming images through mathematical transformation is related to Hadamard Transform Imaging used in X-ray astronomy. A Hadamard transform is analogous to a Fourier transform where the former uses square-wave modulation and the latter uses sine-waves. Computed X-ray tomography is also an is imaging technique that depends upon a mathematical transformation of recorded data (G. K. Sinner, Scientific American 260 (8) (1988) 84; P. J. Treado and M. D. Morris, Anal. Chem. 61 (1989) 723A).

X-ray Moiré patterns produced by X-ray diffraction from two or more crystals have been observed on a macroscopic scale. These patterns are used in studies of crystal defects and are observed in X-ray interferometry (J. Bradley and A. R. Lang, Acta Cryst. A 24 (1964) 246., U. Bonse and M. Hart, Z. Phys. 188 (1965) 154).

BRIEF SUMMARY OF THE INVENTION

It is an object of the present invention to overcome the above problems in X-ray microscopy.

It is a further object of this invention to provide a method and apparatus for image formation based on Fourier transformation of area integrated signals produced by variable Moiré fringes.

It is another object of this invention to provide an imaging technique combined with production and control of Moiré patterns by X-ray diffraction from crystals.

It is a still further object of the invention to provide an X-ray Moiré microscope for use in both a radiography mode and elemental specific microprobe mode.

The above objects are achieved by the instant invention which provides an X-ray Moiré Microscope (XMM) using a relatively large beam of X-rays having a sinusoidal intensity profile which is both well defined and variable on demand by the production of X-ray Moiré patterns via X-ray diffraction from crystals. The X-ray diffraction is typically limited to photon energies greater than 2,000 eV and opens a new portion of the electromagnetic spectrum to microscopy. In the simplest case, X-ray diffraction from single crystals is treated by a two-beam approximation, one beam being the X-rays in the incident (or forward direction) and the second beam being X-rays in the diffracted direction. For single crystals these two beams are treated as a pair, since the diffracted beam can be multiple diffracted back to the forward direction. Dynamical theories of single crystal diffraction (see for example, B. W. Batterman and H. Cole, Rev. Mod. Phys. 36 (1964) 681 predict that asymptotically for thick, absorbing crystals the net effect is that the two X-ray beams interfere to produce X-ray fringes that match the atomic spacing of the crystal lattice, with the maxima of the fringes tending to be located between the atomic planes. This bunching of the photons leads to the well known Borrmann effect (anomalous X-ray transmission). Even in the case of thinner crystals, or weakly absorbing cases where the Borrmann effect is not fully developed, the X-rays will interfere to produce similar X-ray fringe structure.

If the X-ray beam which has become modulated in intensity via diffraction as described above then encounters a second crystal so that the orientation or spacing of the atoms in the second crystal does not match that of the first, the superposition of the Borrmann fringes of the first and second crystal will exhibit a Moiré effect, i.e., in addition to the X-ray intensity modulation at the atomic spacing of the crystal, there will be a longer modulation which is dependent on the relative orientation, d-spacing and position of the two crystals. The spatial frequency and the phase of this Moiré modulation can be varied by appropriate rotations and displacements of the crystals.

For a sample in a Moiré X-ray field, signals which are dependent on the X-ray intensity will be directly related to the Fourier transform of the structure of the sample. The Fourier component which is recorded is related to the spatial wavelength of the Moiré pattern. By varying the Moiré wavelength through a relative rotation of the crystals, and varying the phase of the Moiré pattern through a translation of the crystals, a complete Fourier transform of the structure can be measured.

A mathematical inversion of this measured Fourier transform would reproduce a real-space image of the structure with an arbitrary magnification included in the mathematics. In practice, a complete Fourier transform cannot be measured. Nevertheless, a discrete Fourier transform within a range of wavelengths between short and long wavelength limits results in a transformed image that has a resolution and field of view determined by the range of the Fourier transform.

For the simple case where X-ray diffraction in the crystals can be treated by the two-beam approximation, a measurement involving relative rotation of displacement for the diffracting crystals generates a one-dimensional Fourier transform of the sample structure. To produce a two-dimensional image, a second set of diffracting planes may subsequently be used. Alternatively, a more complicated, two-dimensional Moiré pattern can be generated by using multi-beam diffraction in the two Moiré crystals. In the latter case, the inverse transformation from measurements to recover the real image is not strictly a Fourier transform.

In the simplest case, the recorded signal is the transmitted intensity. Alternatively, the structure of a given atomic species can be determined by using a characteristic signal, such as X-ray fluorescence.

BRIEF DESCRIPTION OF THE DRAWINGS

The invention will now be described in detail with reference to the accompanying drawings wherein.

DETAILED DESCRIPTION

An important feature of the invention is the use of microscopic X-ray Moiré patterns to produce data which can be Fourier transformed into an image. The detailed dependence of the X-ray Moiré patterns upon experimental factors, such as crystal thickness, crystal spacing, number of diffracting crystals, and X-ray divergence are treatable using spherical wave theory of dynamical X-ray diffraction.

The highest sensitivity for an XMM would be achieved in the microprobe mode, i.e., the observed signal would be the characteristic X-rays of a particular element. Using bending magnet X-ray beamlines located at a synchrotron radiation source, one can expect on the order of $10^5$ photons per second to be delivered to a 100 nm square pixel. For example, this would produce 0.1 cps of detected X-ray fluorescence in a conventional Si(Li) X-ray detector from a monolayer coverage of Cu atoms. Image formation at this signal rate would require lengthy integration times, but images of elements with higher area concentrations would be less tedious. Furthermore, wigglers beamlines at existing synchrotrons could increase the signal rate by a factor of 30, and undulator sources such as will be available at the Advanced Photon Source under construction at Argonne National Laboratory in the U.S., and already available at the European Synchrotron Radiation Facility (a complete inventory is given in the Journal of Synchrotron Radiation, Vol. 1, Part 1, October 1994, pp 5–11 by V. P. Suller) will provide another factor of 30 increase to a total gain of 100 in signal. Additional improvements could be expected from improved detector efficiency and optimization of the crystal optics. Thus, detectible signals could be expected even for monolayer coverage with pixel sizes of a few nanometers in dimension.

Figure 1:
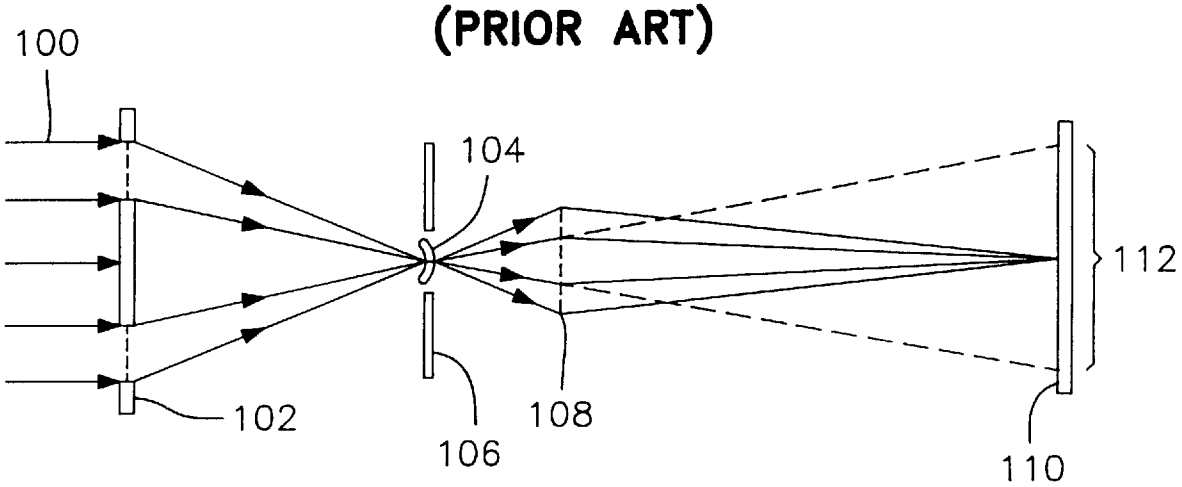
FIG. 1 (PRIOR ART)
FIG. 1 is a schematic diagram of a typical imaging X-ray microscope.
Figure 2:
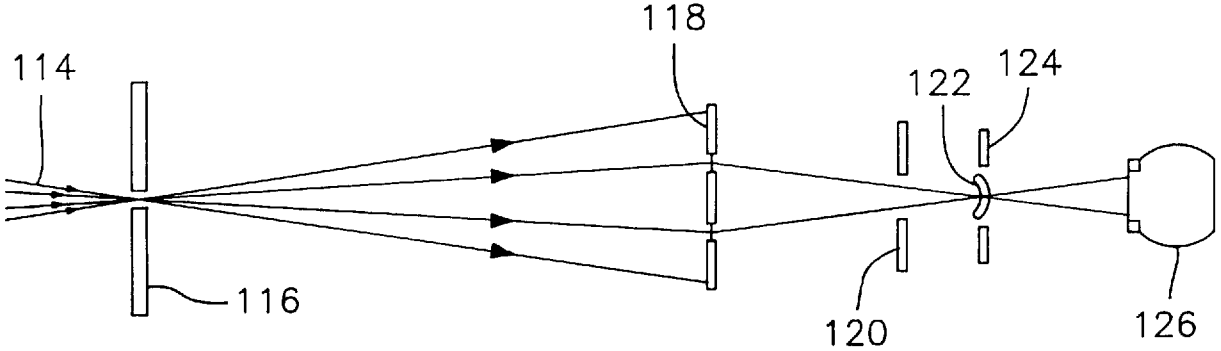
FIG. 2 (PRIOR ART)
FIG. 2 is a view similar to FIG. 1 of a typical scanning X-ray microscope.
Figure 3:
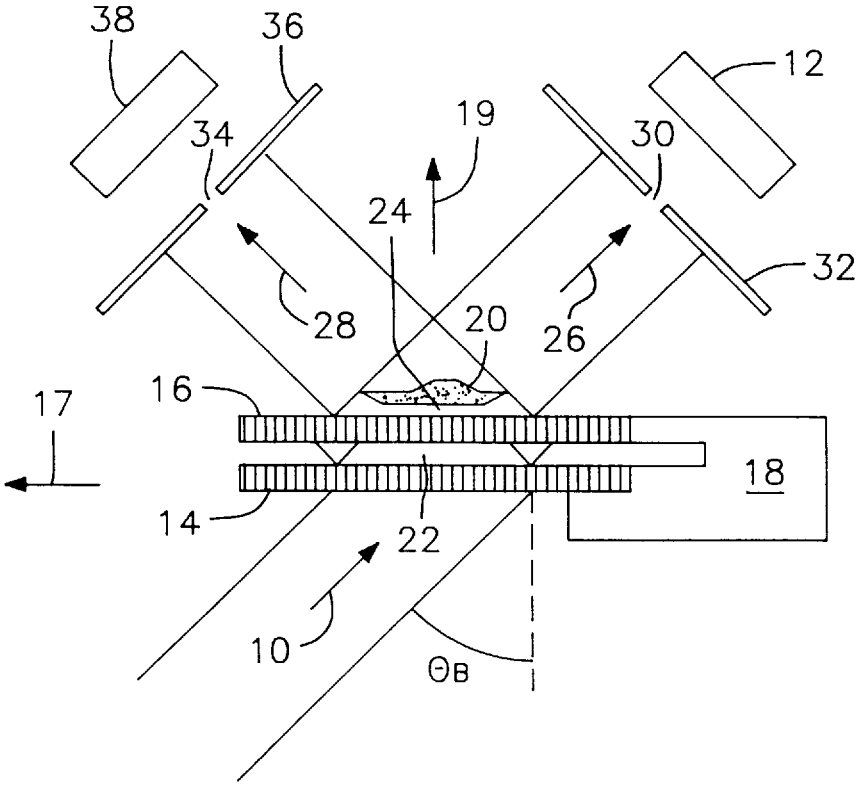
FIG. 3 is a schematic diagram of an X-ray Moiré microscope in accordance with the invention.

In accordance with the invention as shown in FIG. 3, an incident X-ray beam 10 is directed along a linear path toward a forward transmission detector 12. Disposed at an angle $\theta_B$ chosen to satisfy the diffraction condition (see below) and extending across the entire incident X-ray beam 10 are two crystals, 14 and 16, whose translation in the direction of the arrow 17, and rotation relative to one another by a two degree-of-freedom are controlled by a micro-actuator symbolized by the block 18. Crystals 14 and 16 may be silicon or germanium in the form of thin plates having a thickness appropriate to the X-ray wavelength; e.g., for Si at a wave length of 1 Å unit the thickness would be approximately 0.1 mm. The micro-actuator 18 may be a well known flexure mechanism powered by piezo-electric elements such as used in similar applications and as described in "Physik Instrumente" (PI), Catalog 109-12/90-15, section 7, Waldbraun, Germany, pp. 5.6, 5.7 and 8.6. Crystals 14 and 16 are attached in a strain free manner, for example, by gentle clamping or low distortion adhesive means, to the output platforms of actuator 18 (e.g., see PI supra, p. 8.6). Actuator 18 is secured to a stable base (not shown) also supporting the source of X-rays and the sample under investigation 20. Relative rotation about an axis of rotation extending in the direction 19 is used to vary the spatial wavelength of the Moiré fringe field generated as will be now described. The degree of rotation of crystals 14, 16 for a sample having a diameter of 1 mm is about 0.1 microradian to 1 miliradian.

Angle $\theta_B$=arcsin $\lambda/2$ d where $\lambda$ is the X-ray wavelength and d is the spacing 22 between the crystals 14 and 16, which may be of the order of 1 mm or less.

With the second crystal 16 disposed in substantially parallel spaced relation to the first crystal 14 at a small separation 22, an X-ray interference field is produced in the region between the crystals resulting in a second, Moiré, interference field in the region after the second crystal 16 where the sample under investigation 20 is mechanically supported relative to the stable base noted above. The X-ray beam incident on crystal means 14 is modulated in intensity via diffraction as described above and then encounters second crystal means 16 having the orientation or spacing of the atoms thereof not matching those of the first crystal means 14, thereby producing superposition of the Borrmann fringes of the first and second crystal means to exhibit Moiré effect in area 24. Mismatching of the orientation for spacing of the second crystal atoms with respect to the first crystal atoms is controlled by displacement and rotation of the crystal means 14 and 16 as described above. Crystal means 14 and 16 are also mounted for relative displacement in the direction 17 with respect to each other to vary the spacing d at 22 therebetween, so that the spatial frequency and the phase of this Moiré modulation can be varied by the rotation and displacement of the crystals as described above. The displacement in direction 17 is 0.2 to 20 Å depending upon lattice period.

The modulated X-ray beam impinging on sample 20 results in a forward transmitted X-ray beam 26 in the incident, or forward, direction and a second beam 28 in the diffracted direction. Sample 20 may be any material whose native and thickness permit transmission of X-rays. Materials having nonhomogeneous characteristics would be of interest. The forward transmitted beam 26 passes through an aperture 30 in an X-ray opaque material element 32 onto the forward beam detector 12 which may be any of the standard electronic X-ray registration devices or counters. The diffracted beam 28 passes through an aperture 34 in an X-ray opaque material 36 and is directed onto diffracted beam X-ray detector 38. Elements 32 and 36 can be tungsten, lead, molybdenum, or any material having appropriate opacity. Detectors 12 and 38 are a suitable type known in the prior art and fully described in "Radiation and Measurement" by Glenn F. Knoll, John Wiley & Sons, Inc., New York, N.Y. Signals from the detectors are used to determine transmitted intensity, for example, by counting individual X-rays with a scintillation detector, a semiconductor detector or a gas proportional counter. If available intensities are sufficiently large, then the X-ray intensity can be monitored by means of a gaseous or solid state ionization chamber whose average electrical currents are proportional to X-ray intensities. The main steps which are needed to obtain an image are registration of the transmitted intensity (alternative registration modes are given below) for each of a large number of spatial Moiré wavelengths. These will be members of a discrete, uniformly spaced distribution extending over a spatial wavelength range including the size of the smallest object period deemed to be of interest. This discrete array of intensities is an array of squared moduli of the Fourier component of active absorption in the sample. Thus, except for the well-known phase problem, this array can be inverted by Fast Fourier Transform (FFT) methods to produce a one-dimensional image of the distribution of absorption strength in the sample under investigation. By carrying out such an examination in several directions through the sample, one obtains projections of this absorption strength on these directions. Such a minimal dataset is sufficient to allow generation of a three dimensional image for simple objects. For more complex objects, rather high accuracy data are required in many directions. The issue of phase ambiguity may be addressed by translating the object under study at each Moiré wavelength through a Moiré period. Such an operation requires translation refinement to the resolution being sought and the collection of a large amount of data. This data intensive aspect may suggest a practical limitation in the application of the Moiré microscope to a large number of problems but does not appear to be insurmountable.

A two-dimensional image can be produced by providing a second set of diffraction planes subsequent to that shown in FIG. 3, between the crystals and the sample.

Precision motion techniques developed for X-ray interferometry and scanning tunneling microscopy are transferable. Since neutron diffraction from single crystals has very similar behavior to X-ray diffraction, a neutron Moiré Microscope (NMM) is in principle possible by analogy to the XMM of the invention. One significant difference is that the low absorption coefficient for neutrons would make the Borrmann effect unusable, but neutron Moiré patterns during diffraction could nonetheless be procured. The major obstacle to the practical application of an NMM would be the relatively low brightness of conventional neutron sources compared to synchrotron X-ray sources. Nevertheless, the sensitivity of neutrons to certain material properties, such magnetism, may make the NMM an eminently suitable instrument for some applications.

X-ray microscopy has many advantages over the widely employed electron microscopy including decreased sample damage, reduced background signal and the ability to study samples in situ. This invention is a significant departure from the approaches for developing high resolution X-ray microscopes and holds the potential for atomic resolution, chemical specificity, and high photon energy operation.

I claim:

1. An X-ray Moiré microscope comprising:

a source of incident X-rays for producing an initial beam of X-rays in a predetermined path;

first crystal means extending across said predetermined path at a predetermined angle thereto;

second crystal means extending across said predetermined path in substantially parallel spaced relationship downstream of said first crystal with respect to said predetermined path;

means for mounting said crystals for rotational and translational displacement with respect to each other and said predetermined path so that the orientation of atoms in said second crystal do not match the orientation of atoms in said first crystal, to produce a forward X-ray beam in the direction of said predetermined path downstream of said second crystal means and a diffracted X-ray beam from said second crystal means at an angle relative to said predetermined path;

a sample disposed in spaced relationship downstream of said second crystal with respect to said predetermined path for receiving said forward and diffracted X-ray beams;

a forward beam detector downstream of said crystal means in the direction of said predetermined path for receiving said forward X-ray beam passing through said sample; and a diffracted beam detector for receiving said diffracted X-ray beam passing through said sample.

2. The X-ray microscope as claimed in claim 1 wherein:

said first and second crystal means each comprise a thin plate of Si having an X-ray wave length of I Å unit and a thickness of substantially 0.1 mm.

3. The X-ray microscope as claimed in claim 1 wherein:

said crystal means extend across said predetermined path of said incident X-ray beam at an angle $\theta_B$=arcsin ($\lambda$/2 d) where $\lambda$ is the X-ray wavelength and d is the spacing between said crystals.

4. The X-ray microscope as claimed in claim 2 wherein:

said crystal means extend across said predetermined path of said incident X-ray beam at an angle $\theta_B$=arcsin ($\lambda$/2 d) where $\lambda$ is the X-ray wavelength and d is the spacing between said crystals.

5. The X-ray microscope as claimed in claim 1 and further comprising:

first aperture means between said second crystal means and said forward beam detector for controlling said forward X-ray beam incident on said forward beam detector; and second aperture means between said second crystal means and said diffracted beam detector for controlling said diffracted X-ray beam incident on said diffracted beam detector.

6. The X-ray microscope as claimed in claim 2 and further comprising:

first aperture means between said second crystal means and said forward beam detector for controlling said forward X-ray beam incident on said forward beam detector; and second aperture means between said second crystal means and said diffracted beam detector for controlling said diffracted X-ray beam incident on said diffracted beam detector.

7. The X-ray microscope as claimed in claim 3 and further comprising:

first aperture means between said second crystal means and said forward beam detector for controlling said forward X-ray beam incident on said forward beam detector; and second aperture means between said second crystal means and said diffracted beam detector for controlling said diffracted X-ray beam incident on said diffracted beam detector.

8. The X-ray microscope as claimed in claim 5 wherein:

said first aperture means comprises a first X-ray opaque element extending across said forward X-ray beam between said second crystal means and said forward beam detector, and an aperture in said first X-ray opaque element; and said second aperture means comprises a second X-ray opaque element extending across said diffracted X-ray beam between said second crystal means and said diffracted X-ray detector, and an aperture in said second X-ray opaque element.

9. A method of investigating material by the use of X-rays comprising:

providing an incident X-ray beam in a predetermined path;

directing said incident X-ray beam onto a pair of crystals in spaced substantially parallel relationship with respect to each other and extending across said incident X-ray beam at a predetermined angle thereto;

adjusting the relative spacing between said crystals;

adjusting the relative rotational and translational disposition of said crystals with respect to each other and said predetermined path to mismatch the orientation of atoms in said crystals with respect to each other to produce a forward X-ray beam in the direction of said predetermined path downstream of said crystals and a diffracted X-ray beam at an angle to said forward X-ray beam from said crystals;

directing said forward and diffracted X-ray beams onto a sample;

directing said forward beam from said sample onto a forward beam detector; and directing said diffracted beam from said sample onto a diffracted beam detector.

10. The method as claimed in claim 9 and further comprising:

controlling said incident X-ray beam modulation pattern to approximately 0.2 Å units by adjusting the relative position of said crystals.

* * * * *